US010107589B2

(12) United States Patent
Neuhaus

(10) Patent No.: US 10,107,589 B2
(45) Date of Patent: Oct. 23, 2018

(54) WEAPON SIGHTING DEVICE

(71) Applicant: George Neuhaus, Skokie, IL (US)

(72) Inventor: George Neuhaus, Skokie, IL (US)

( * ) Notice: Subject to any disclaimer, the term of this patent is extended or adjusted under 35 U.S.C. 154(b) by 25 days.

(21) Appl. No.: 15/352,224

(22) Filed: Nov. 15, 2016

(65) Prior Publication Data

US 2018/0135940 A1 May 17, 2018

(51) Int. Cl.

| | |
|---|---|
| ***F41G 1/00*** | (2006.01) |
| ***F41G 1/01*** | (2006.01) |
| ***F41G 1/02*** | (2006.01) |
| ***F41G 1/12*** | (2006.01) |

(52) U.S. Cl.

CPC ..... *F41G 1/01* (2013.01); *F41G 1/02* (2013.01); *F41G 1/12* (2013.01)

(58) Field of Classification Search

CPC ..... F41G 1/01; F41G 1/02; F41G 1/10; F41G 1/32; F41G 1/345; F41G 1/12

USPC ..... 42/111, 132, 144, 145, 137

See application file for complete search history.

(56) References Cited

U.S. PATENT DOCUMENTS

| | | | |
|---|---|---|---|
| 3,698,091 | A | 10/1972 | Merrill et al. |
| 3,984,917 | A | 10/1976 | Korzeniewski |
| 4,734,989 | A | 4/1988 | Sanders |
| 7,540,108 | B2 | 6/2009 | Irwin |
| 8,230,637 | B2 | 7/2012 | Lamb |
| 8,677,674 | B2 | 3/2014 | Glimpse et al. |

*Primary Examiner* — Michael D David

(57) ABSTRACT

A weapon sighting device facilitates aiming a weapon without obscuring a visual line to the desired target point. The device includes a front mount coupled to a forward end of a weapon. A front sight is coupled to the front mount having a pair of outer flanges extending upwardly from the front mount. The outer flanges are spaced apart to permit direct visual sighting of a target point between the outer flanges of the front sight. A rear sight is coupled to a rear mount on the rearward end of the weapon. A pair of peripheral flanges extending upwardly from the rear mount are spaced apart wherein the outer flanges are visible between the peripheral flanges when in an aimed position.

11 Claims, 3 Drawing Sheets

WEAPON SIGHTING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to sighting devices and more particularly pertains to a new sighting device for aiming a weapon without obscuring a visual line to the desired target point.

BRIEF SUMMARY OF THE INVENTION

An embodiment of the disclosure meets the needs presented above by generally comprising a front mount coupled to a forward end of a weapon. A front sight is coupled to the front mount having a pair of outer flanges extending upwardly from the front mount. The outer flanges are spaced apart to permit direct visual sighting of a target point between the outer flanges of the front sight. A rear sight is coupled to a rear mount on the rearward end of the weapon. A pair of peripheral flanges extending upwardly from the rear mount are spaced apart wherein the outer flanges are visible between the peripheral flanges when in an aimed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
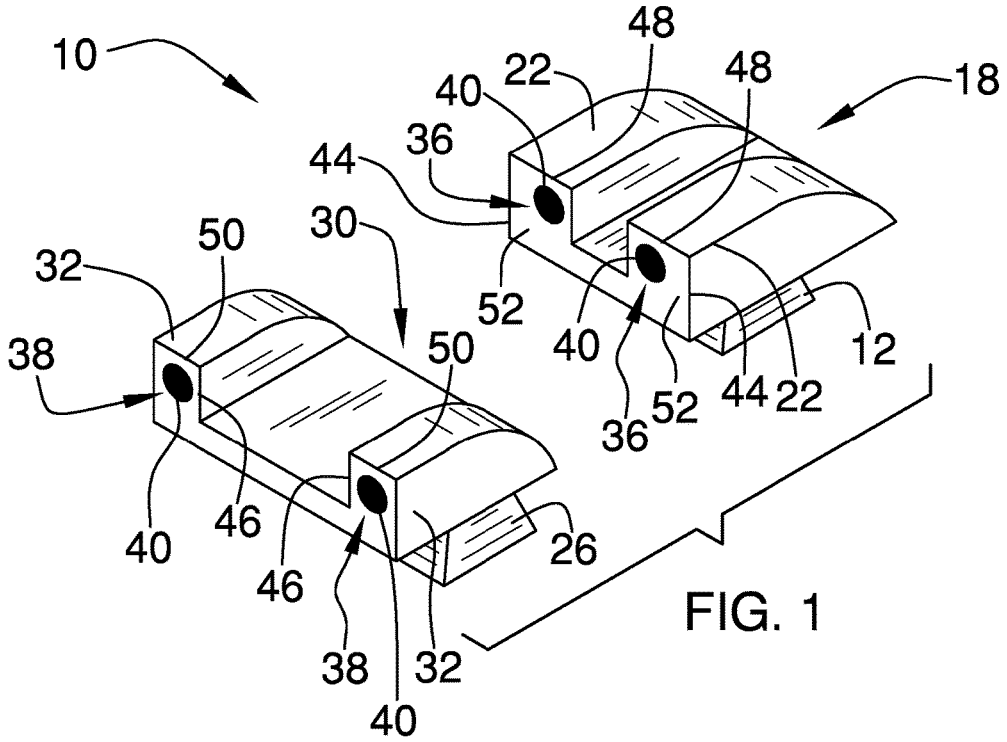
FIG. 1 is a top front side perspective view of a weapon sighting device according to an embodiment of the disclosure.
Figure 2:
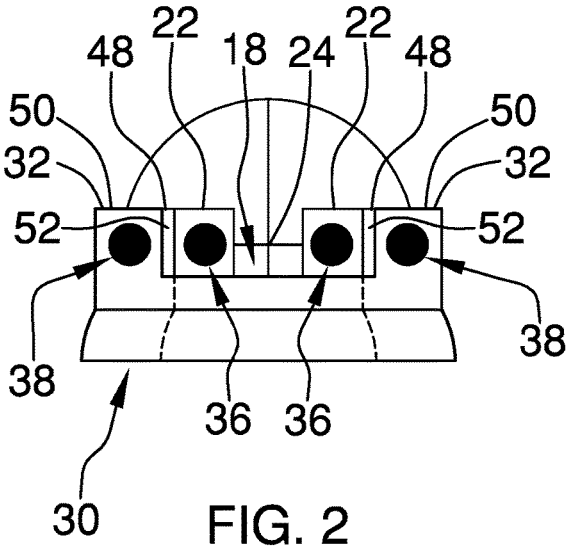
FIG. 2 is a front view of an embodiment of the disclosure.
Figure 3:
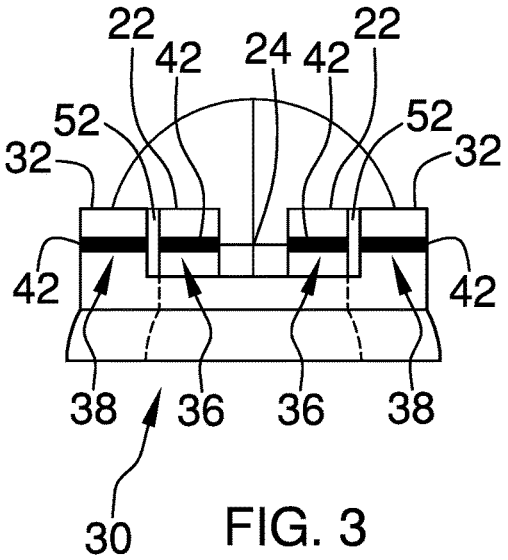
FIG. 3 is a front view of an embodiment of the disclosure.
Figure 4:
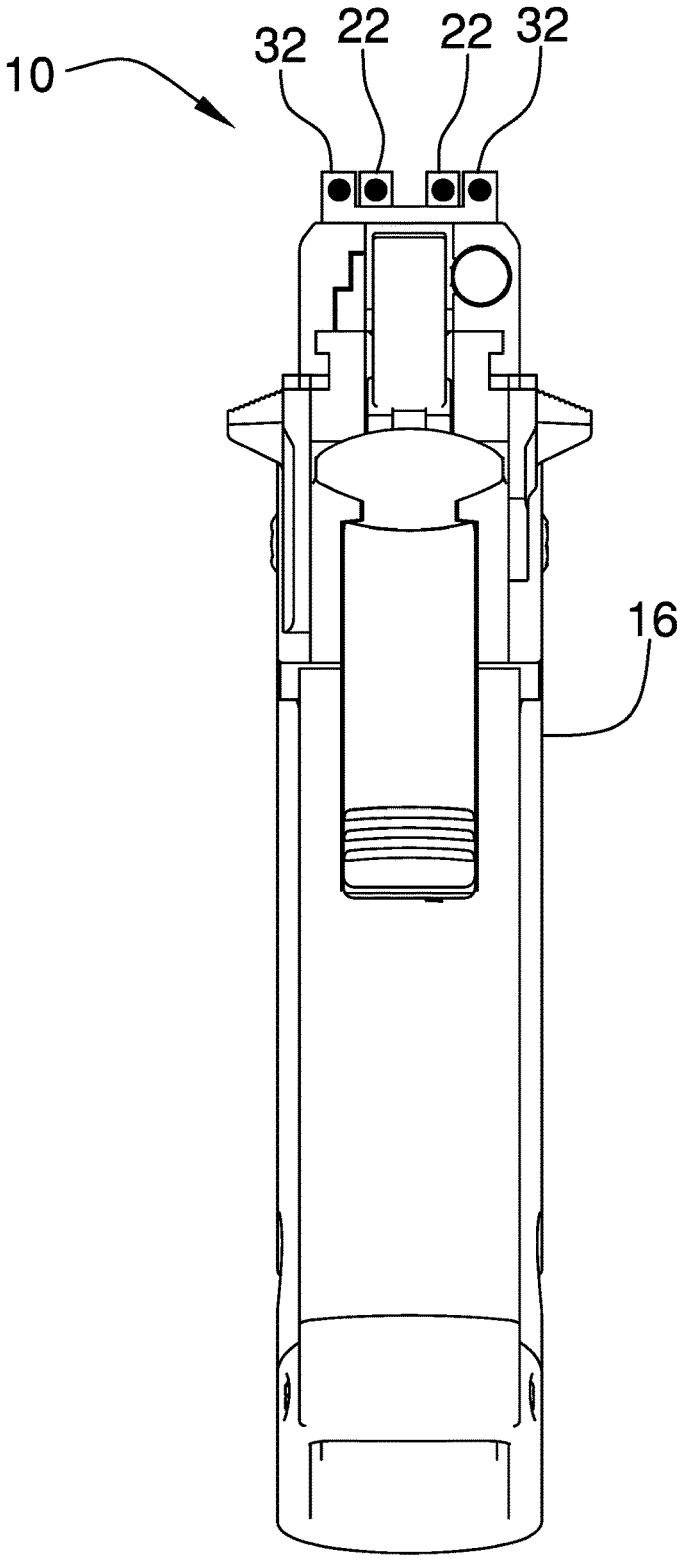
FIG. 4 is a front view of an embodiment of the disclosure installed on a weapon.
Figure 5:
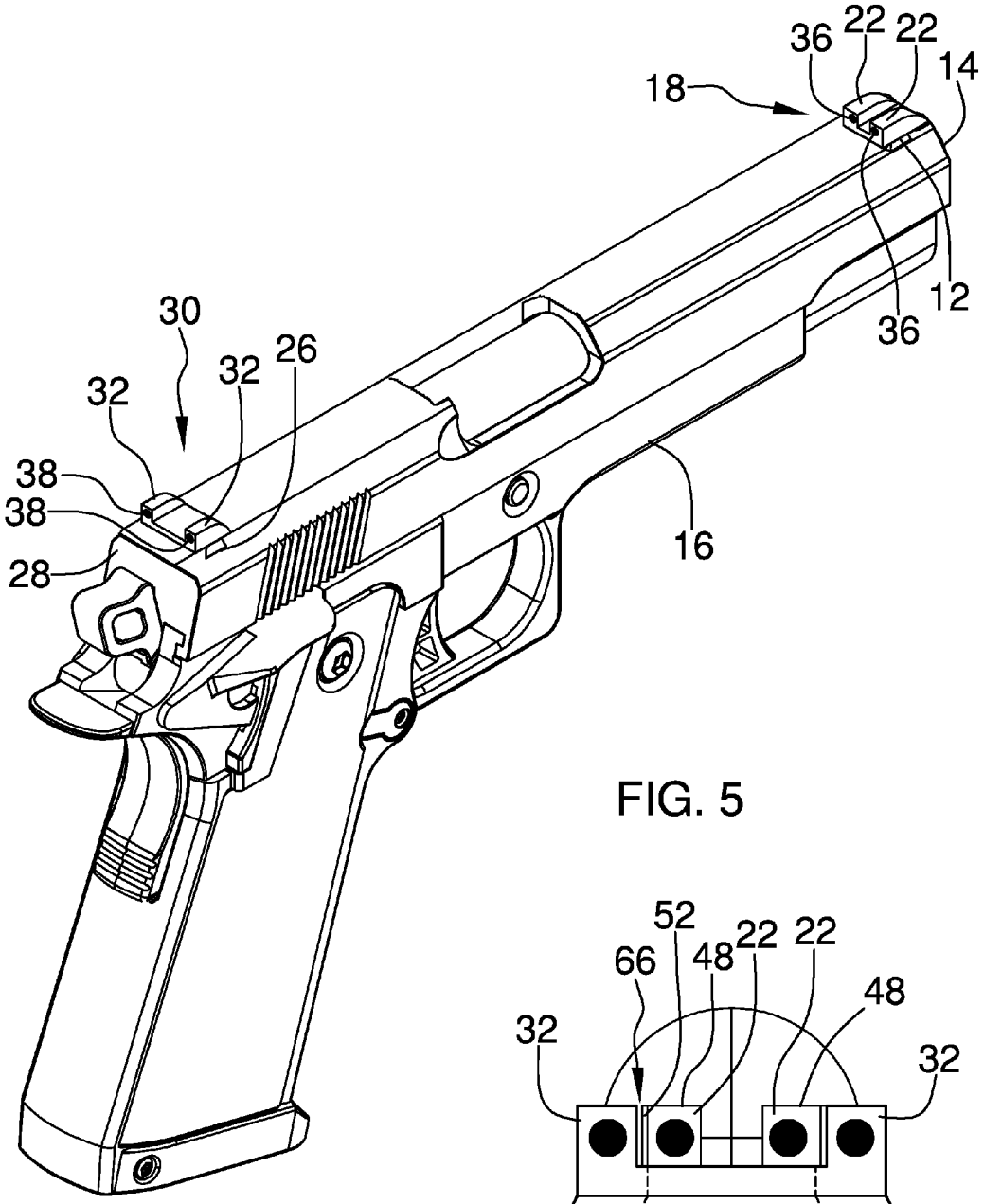
FIG. 5 is a top front side perspective view of an embodiment of the disclosure.

With reference now to the drawings, and in particular to FIGS. 1 through 6 thereof, a new sighting device embodying the principles and concepts of an embodiment of the disclosure and generally designated by the reference numeral 10 will be described.

As best illustrated in FIGS. 1 through 6, the weapon sighting device 10 generally comprises a front mount 12 configured for being coupled to a forward end 14 of a weapon 16. A front sight 18 is coupled to the front mount 12. The front sight 18 has a pair of outer flanges 22 extending upwardly from the front mount 18. The outer flanges 22 are spaced apart wherein the outer flanges 22 of the front sight 12 are configured to permit direct visual sighting of a target point 24 between the outer flanges 22 of the front sight 12.

A rear mount 26 is configured for being coupled to a rearward end 28 of the weapon 16. A rear sight 30 is coupled to the rear mount 26. The rear sight 30 has a pair of peripheral flanges 32 extending upwardly from the rear mount 26. The peripheral flanges 32 are spaced apart wherein the outer flanges 22 of the front sight 18 are visible between the peripheral flanges 32 when the rear sight 30 is aligned with the front sight 18 to define an aimed position 34.

Figure 6:
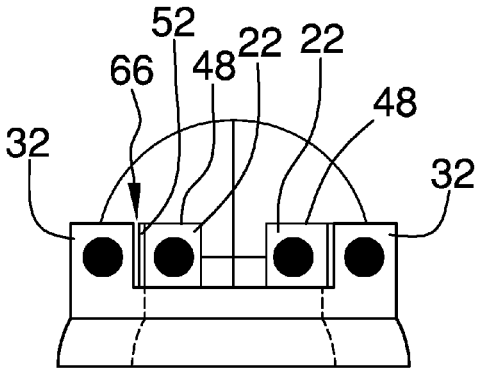
FIG. 6 is a front view of an embodiment of the invention in a misaligned state.

Outer edges 44 of each of the outer flanges 22 of the front sight 18 are aligned with an associated one of inner edges 46 of the peripheral flanges 32 of the rear sight 30 in the aimed position 34. Thus, the front sight 18 is configured for indicating misalignment when a gap 66 is visible between one of the outer flanges 22 and the peripheral flange 32 while aiming as shown in FIG. 6. A vertical outer section 52 of each of the outer flanges 22 of the front sight 18 is a contrasting color to the peripheral flanges 32 of the rear sight 30. For example, the peripheral flanges 32 may be black while the outer sections 52 may be defined by a white line or band extending along the outer edge 44. A top edge 48 of each of the outer flanges 22 is aligned with topmost edges 50 of the peripheral flanges 32 of the rear sight 30 when in the aimed position 34.

Each of a pair of front sight markings 36 is positioned on an associated one of the outer flanges 22 of the front sight 18. The pair of front sight markings 36 is visible between the peripheral flanges 32 when the front sight 18 and the rear sight 30 are in the aimed position 34. Each of a pair of rear sight markings 38 is linearly aligned with the front sight markings 36 when the front sight 18 and the rear sight 30 are in the aimed position 34.

Each of the front sight markings 36 and the rear sight markings 38 comprises a circular dot 40, a line 42, or the like. The front sight markings 36 and rear sight markings 38 may all be similar or a combination of the dots 40 and lines 42.

In use, the front sight 18 and rear sight 30 are installed and adjusted on the weapon 16 in a substantially conventional manner using the front mount 12 and rear mount 26. As opposed to conventional sights, the front sight 18 provides separation between the outer flanges 22 such that proper aiming dictates positioning of the target point 24 between the outer flanges 22 where the target point 24 remains visible. The peripheral flanges 32 of the rear sight 30 are aligned with the outer flanges 22 of the front sight 18 while maintaining the target point 24 between the outer flanges 22. When properly installed and adjusted, alignment of the front sight 18 and rear sight 30 as described will result in the weapon firing directly at the target point 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weapon sighting device comprising:

a front mount configured for being coupled to a forward end of a weapon;

a front sight coupled to said front mount, said front sight having a pair of outer flanges extending upwardly from said front mount, said outer flanges being spaced apart wherein said outer flanges of said front sight are configured to permit direct visual sighting of a target point between said outer flanges of said front sight;

a rear mount configured for being coupled to a rearward end of the weapon;

a rear sight coupled to said rear mount, said rear sight having a pair of peripheral flanges extending upwardly from said rear mount, said peripheral flanges being spaced apart wherein said outer flanges of said front sight are visible between said peripheral flanges when said rear sight is aligned with said front sight to define an aimed position; and wherein outer edges of each of said outer flanges of said front sight are aligned with an associated one of inner edges of said peripheral flanges of said rear sight in said aimed position wherein said front sight is configured for indicating misalignment when gaps are visible between said outer flanges and said peripheral flanges while aiming.

2. The device of claim 1, further comprising a pair of front sight markings, each of said front sight markings being positioned on an associated one of said outer flanges of said front sight, said pair of front sight markings being visible between said peripheral flanges when said front sight and said rear sight are in said aimed position.

3. The device of claim 2, further comprising a pair of rear sight markings, each of said rear sight markings being linearly aligned with said front sight markings when said front sight and said rear sight are in said aimed position.

4. The device of claim 3, further comprising each of said front sight markings and said rear sight markings comprising a circular dot.

5. The device of claim 3, further comprising each of said front sight markings and said rear sight markings comprising a line.

6. The device of claim 1, further comprising a top edge of each of said outer flanges being aligned with topmost edges of said peripheral flanges of said rear sight when in said aimed position.

7. The device of claim 1, further comprising a vertical outer section of each of said outer flanges of said front sight being a contrasting color to said peripheral flanges of said rear sight.

8. The device of claim 1, further comprising a vertical outer section of each of said outer flanges of said front sight being a contrasting color to said peripheral flanges of said rear sight.

9. A weapon sighting device comprising:

a front mount configured for being coupled to a forward end of a weapon;

a front sight coupled to said front mount, said front sight having a pair of outer flanges extending upwardly from said front mount, said outer flanges being spaced apart wherein said outer flanges of said front sight are configured to permit direct visual sighting of a target point between said outer flanges of said front sight;

a rear mount configured for being coupled to a rearward end of the weapon;

a rear sight coupled to said rear mount, said rear sight having a pair of peripheral flanges extending upwardly from said rear mount, said peripheral flanges being spaced apart wherein said outer flanges of said front sight are visible between said peripheral flanges when said rear sight is aligned with said front sight to define an aimed position;

a pair of front sight markings, each of said front sight markings being positioned on an associated one of said outer flanges of said front sight, said pair of front sight markings being visible between said peripheral flanges when said front sight and said rear sight are in said aimed position; and a pair of rear sight markings, each of said rear sight markings being linearly aligned with said front sight markings when said front sight and said rear sight are in said aimed position;

outer edges of each of said outer flanges of said front sight being aligned with an associated one of inner edges of said peripheral flanges of said rear sight in said aimed position wherein said front sight is configured for indicating misalignment when gaps are visible between said outer flanges and said peripheral flanges while aiming;

a top edge of each of said outer flanges being aligned with topmost edges of said peripheral flanges of said rear sight when in said aimed position; and a vertical outer section of each of said outer flanges of said front sight being a contrasting color to said peripheral flanges of said rear sight.

10. The device of claim 9, further comprising each of said front sight markings and said rear sight markings comprising a circular dot.

11. The device of claim 9, further comprising each of said front sight markings and said rear sight markings comprising a line.

* * * * *